US011684160B1

(12) United States Patent
Olarte

(10) Patent No.: US 11,684,160 B1
(45) Date of Patent: Jun. 27, 2023

(54) LOW ENVELOPE CHAIR WITH HIGH BACK PITCH

(71) Applicant: Series International, LLC, Aventura, FL (US)

(72) Inventor: Alvaro Mauricio Olarte, Aventura, FL (US)

(73) Assignee: Series International, LLC, Aventura, FL (US)

( * ) Notice: Subject to any disclaimer, the term of this patent is extended or adjusted under 35 U.S.C. 154(b) by 0 days.

(21) Appl. No.: 17/863,858

(22) Filed: Jul. 13, 2022

(51) Int. Cl.
*A47C 1/121* (2006.01)

(52) U.S. Cl.
CPC ..... *A47C 1/121* (2013.01)

(58) Field of Classification Search
CPC ..... A47C 1/121; A47C 7/46
USPC ..... 297/335, 452.31
See application file for complete search history.

(56) References Cited

U.S. PATENT DOCUMENTS

| | | | | | |
|---|---|---|---|---|---|
| 216,307 | A * | 6/1879 | Case | F16C 11/04 | 297/335 |
| 272,166 | A * | 2/1883 | Shepler | B60N 2/305 | 297/335 |
| 646,290 | A * | 3/1900 | Kratz | A47C 7/46 | 52/800.11 |
| 1,922,582 | A * | 8/1933 | Goodrich | A47C 1/12 | 297/169 |
| 6,293,621 | B1 * | 9/2001 | Marsh | A47C 7/566 | 297/335 |
| 2005/0168032 | A1 * | 8/2005 | Olarte | A47C 11/005 | 297/331 |
| 2007/0138849 | A1 * | 6/2007 | Olarte | A47C 11/005 | 297/257 |
| 2011/0115269 | A1 * | 5/2011 | Roeder | A47C 7/46 | 297/284.4 |
| 2020/0154892 | A1 * | 5/2020 | Olarte | A47C 1/121 | |

FOREIGN PATENT DOCUMENTS

| | | | | |
|---|---|---|---|---|
| CN | 107692625 A | * | 2/2018 | A47C 7/38 |
| CN | 108814092 A | * | 11/2018 | |
| DE | 102008059016 | * | 4/2010 | A47C 1/121 |

* cited by examiner

*Primary Examiner* — Milton Nelson, Jr.
(74) *Attorney, Agent, or Firm* — St. Onge Steward Johnston & Reens LLC

(57) ABSTRACT

A low envelope chair with a back that includes portions with relative high back pitches at the lower ends and other higher portions with relatively low back pitches to give the overall feeling of a high back pitch chair while retaining the low envelope. By low envelope, generally less than approximately 17 inches, preferably approximately 16 inches or less or even more preferably approximately 15 inches or less are contemplated with respect to chairs that have a tilt up seat. A high back pitch would generally be more than 15 degrees, preferably more than 20 degrees, preferably more than 25 degrees and even more preferably more than 30 degrees.

26 Claims, 6 Drawing Sheets

LOW ENVELOPE CHAIR WITH HIGH BACK PITCH

FIELD OF THE INVENTION

The following relates to seating. More specifically, auditorium and stadium seating using "fixed chairs".

BACKGROUND OF THE INVENTION

In the seating industry, the term "fixed chair" refers to chairs which are fixed to the floor/structure of the stadium/auditorium. This might include chairs fixed to a movable riser in addition to chairs bolted to concrete floors, stadium risers and the like or chairs which are beam mounted with the beam mounted to concrete. These fixed chairs will ordinarily not be moveable from their position without use of tools. Many fixed chairs include tilt up seats as well, thus a "fixed chair" does not require the seat itself to be in an immovable occupiable position.

In contrast to "fixed" chairs, moveable chairs generally include those which are designed to be regularly brought in and out of storage depending on the needs of a particular venue. Some of these may fold, others may be stacked on cars and rolled into/out of storage. For example, a large venue space may host both a conference with presentations and a wedding. The seating needs for both situations will vary and moveable chairs will be used. Fixed chairs in contrast are those which are typically found at large sports stadiums, theaters and other auditoriums where the seating configuration is generally static from event to event. Although, some fixed chairs are mounted on beams and are designed to be removed/moved through use of tools. Moveable chairs can typically be moved by the person sitting on them, however, sometimes moveable chairs will connect to adjacent moveable chairs to provide a more secure row configuration. In this case, the feet or ends of the legs of the chairs remain un-attached to the floor or other support.

Fixed chairs have unique needs relative to moveable chairs. Specifically, since the fixed chairs are designed to be bolted or otherwise secured to a stationary structure and to not be moveable by the general public, fire codes are in place to ensure adequate egress from rows since the chairs being fixed in place pose an obstacle to egress.

As a result, the term "envelope" in the fixed chair industry will generally determine the seating capacity of a particular space. This envelope refers to the horizontal distance from the front to the back of the chair and is normally applied and regulated in situations where rapid egress is needed. Some fixed chairs have seats which are permanently down and do not tilt, thus the envelope of this chair would be measured from the rearmost portion of the chair to the front of the seat. The envelope for a chair with a tilt up seat would be measured from the rear of the seat to the front most portion with the seat up (i.e. the position the seat would be in if the occupants stood up and were trying to exit the row). Generally chairs with tilt up seats use an automatic mechanism to rotate the seat to the stored or unoccupied position such as a gravity or spring mechanism. As a result, the envelope would be measured in the unoccupied position in that when egress is needed the open space in the aisle would be determined by the seat being up.

Although reduction of envelope may allow for more row space, the reduction of the envelope has significant comfort problems in that smaller envelopes mean less back pitch and a less comfortable chair.

SUMMARY OF THE INVENTION

It is therefore an object of the invention to provide a low envelope chair which provides superior comfort compared to other low envelope chairs.

The combination of the envelope and minimum fire code aisle width determines the minimum depth of each row. This minimum fire code aisle width or "access" or "clear passage" is also dependent on how many chairs are in the row and if the row has access to an aisle on both sides or just on one side. Current codes (IBC) designate passage at 12" for seven chairs with access to one aisle, or 14 chairs with access to two aisles. If a row has more than 7/14 chairs, formulas are used to calculate the minimum clear passage. For a section of chairs with access to one aisle, the formula is "No. of Chairs Over 7×0.6"+12=min. Clear Passage". For a section of chairs with access to two aisles, the formula is "No. of Chairs Over 14×0.3"+12=min. Clear Passage". It is understood that fire codes may change from time to time and different codes may apply, depending on the location and configuration of the seating.

However, according to the IBC code rows with more chairs will require a larger clear passage space, but in any situation, there is a minimum clear space width. While this fire code may set a minimum, some auditorium designs will utilize a wider clear passage space to provide a more comfortable experience to patrons. But, in either case, the combination of envelope and the clear passage determines the space that each row will take up. Assuming the envelope of a chair is 17 inches and the clear passage in the particular design is 19 inches, each row will take up 36 inches and thus 30 rows will require 90 feet. However, if the envelope of the chair is reduced to 15 inches, that same 90 feet can now hold almost 32 rows of chairs—nearly two additional rows the auditorium can sell within the same overall building footprint, all with the same amount of clear space in the aisle.

However, reduction of the envelope limits the comfort of the chair as the back pitch typically cannot be as high on a 15 inch envelope chair as compared to a 19 inch envelope chair since every degree of back pitch increases envelope size.

Accordingly, the stated object and other objects of the invention are achieved by providing a low envelope chair with a back that includes portions with relative high back pitches and other portions with relatively low back pitches to give the overall feeling of a high back pitch chair while retaining the low envelope. By low envelope, generally less than 17 inches, preferably 16 inches or less or even more preferably 15 inches or less are contemplated with respect to chairs that have a tilt up seat. A high back pitch would generally be more than 15 degrees, preferably more than 20 degrees, preferably more than 25 degrees and even more preferably more than 30 degrees. A back pitch or pitch angle or angle can also be measured by placing a straight edge against a curved surface (or a flat surface) or measuring between two points to measure the pitch of the straight edge in inches horizontally (usually rearward) per inch vertically (usually upward).

In one aspect the chair includes a support, a back and a seat, the back and seat supported by the support and the seat pivotable with respect to the back. The support, back and seat define a fixed chair with an envelope of 17 inches or less. The back defines a backrest surface with a plurality of sections comprising first, second and third sections each having a different pitch with lower ones of the plurality of sections causing a backrest surface to extend a greater distance rearward per distance upwards as compared to upper ones of the plurality of sections which extend rearwards less per distance upwards, for example, greater by a factor of 1.25 or more, 1.5 or more, 1.75 or more or 2 or more.

In certain aspects a hinge is configured to allow the seat to pivot between occupied and unoccupied positions wherein the support entirely obscures the seat from view from a side view of the chair when the seat is in the occupied position. In other aspects at least a first one of the lower ones of the plurality of sections has a first pitch of half an inch or more rearward per inch upward. In still other aspects the first pitch is measured between two points on the first one of the lower ones of the plurality of sections and the first one of the lower ones of the plurality of sections is curved. In still other aspects one of the upper ones of the plurality of sections has a second pitch of less than half an inch rearward per inch upward. In yet other aspects one of the plurality of sections is flat and pitched back at an angle of 25 degrees or more.

In yet other aspects the first section is located at a lower end of the backrest and having a pitch angle less than 20 degrees or a convex radius and extending a first distance. The second section is located above the first section and has a pitch angle greater than 25 degrees or a concave radius of at least 11 inches and extending a second distance. The third section is further located above the second section and having a pitch angle less than 20 degrees or a radius of 20 inches or greater and extending a third distance.

In other aspects one or more of the first, second and third ones of the plurality of sections are curved. In other aspects one or more of the first, second and third ones of the plurality of sections are straight. In yet other aspects the envelope is 16 inches or less and at least a portion of the backrest includes a rearward pitch of 0.5 inches rearward or more per inch upward as measured between two points on a backrest surface of the backrest. In yet other aspects the envelope is 15.5 inches or less. In still other aspects a fourth section of the plurality of sections is located above the third section and has a pitch angle less than 5 degrees and extending a fourth distance. In yet other aspects the fourth section is located above the third section and has a pitch angle less than 1.5 degrees and extends a fourth distance. In other aspects each of the plurality of sections has a first and second end, the first end located lower than the second end and the second end of the first section is spaced from the first end of the second section. The the second section may have a length of at least 25% of the envelope. In yet other aspects, the seat is pivotable through a first angle, a lower surface of the seat is at a second angle relative to horizontal in the occupied position of the seat and a seating surface of the seat is at a third angle relative to horizontal in the occupied position and wherein a sum of the first, second and third angles is approximately 90 degrees and each of the first, second and third angles are different.

In other aspects the chair is provided with a support, a back and a seat, the back and seat supported by the support and the seat pivotable with respect to the back, and the support, back and seat defining a fixed chair with an envelope of 17 inches or less. The back defines a backrest surface comprising a plurality of sections comprising first, second and third sections and a rear surface wherein a thickness of the back measured between the backrest surface and the rear surface is constant along 50% or more of the back. The first section is located at a lower end of the backrest and having a first pitch and extending a first distance. The second section is located above the first section and having a second pitch and extending a second distance. The third section is located above the second section and having a third pitch extending a third distance. The second pitch is at least 1.5 times that of the first and the third pitches.

In certain aspects the second pitch is at least 28 degrees and the envelope is 16 inches or less. In other aspects the envelope is measured horizontally between a front most portion of the support and a rear most portion of the back with the seat in an unoccupied position. In other aspects the thickness of the back measured between the backrest surface and the rear surface is constant along 50% or more of an entire surface area of a backrest surface of the backrest. In other aspects the seat has a seating surface and a lower surface and wherein in the unoccupied position the lower surface is approximately parallel to a front of the support. In yet other aspects the support includes a front profile and a rear profile and a portion of the rear profile matches a profile of a rear surface of the seat back. In other aspects the second section has a length of at least 20% of the envelope. In still other aspects a height of the seat from a bottom of the support to a top of the back is at least 32 inches and ends of the second section are spaced vertically by 15% of the height.

In other aspects the chair includes a support, a back and a seat, the back and seat supported by the support and the seat pivotable with respect to the back, and the support, back and seat defining a fixed chair with an envelope of 16 inches or less. The back defines a backrest surface comprising a plurality of sections comprising first, second and third sections and a rear surface. The first section is located at a lower end of the backrest and having a convex radius and extending a first distance. The second section is located above the first section and has a pitch of at least 25 degrees and extending a second distance. The third section is located above the second section and has a concave radius and extends a third distance. The convex radius and the concave radius in inches are within 35% of each other. In certain aspects the radius of the first and second sections are each within 25% to 75% of the radius of the third section.

In other aspects the chair includes a support, a back and a seat, the back and seat supported by the support and the seat pivotable with respect to the back, and the support, back and seat defining a fixed chair with an envelope of 16 inches or less. The back defines a backrest surface comprising a plurality of sections comprising first, second and third sections and a rear surface. The first section is located at a lower end of the backrest and having a first radius and extending a first distance. The second section is located above the first section and having a pitch of at least 25 degrees and extending a second distance. The third section is located above the second section and has a second radius and extending a third distance. The fourth section is located above the third section and has a third radius. The first radius and the second radius in inches are each within 25% to 75% of the third radius.

Other objects of the invention and its particular features and advantages will become more apparent from consideration of the following drawings and accompanying detailed description.

DETAILED DESCRIPTION OF THE INVENTION

Figures 1, 2:
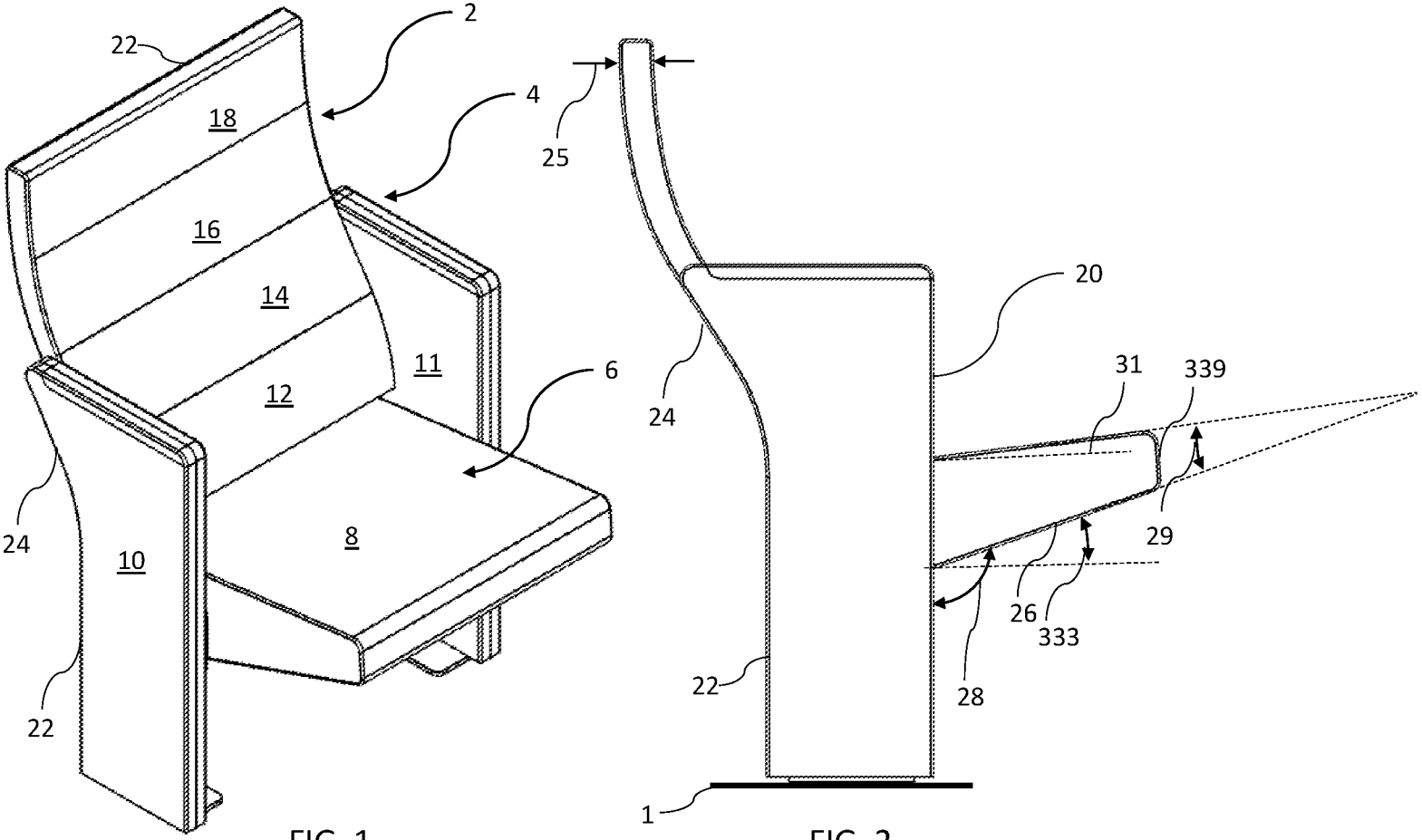
FIG. 1 is a perspective view of a chair according to the invention in the open or occupied position.
FIG. 2 is a side view of the chair of FIG. 1
Figure 4:
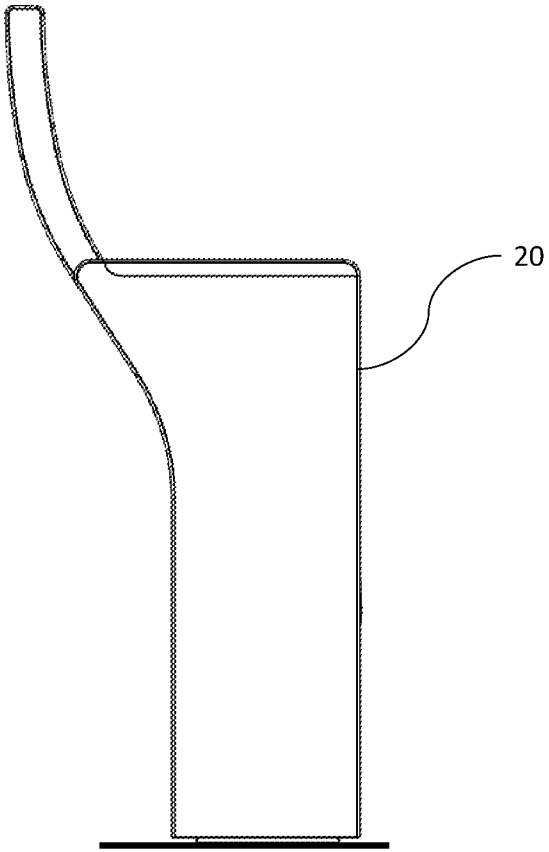
FIG. 4 is a side view of the chair of FIG. 1 in the unoccupied or closed position.

Referring now to the drawings, wherein like reference numerals designate corresponding structure throughout the views. The following examples are presented to further illustrate and explain the present invention and should not be taken as limiting in any regard.

Figure 11:
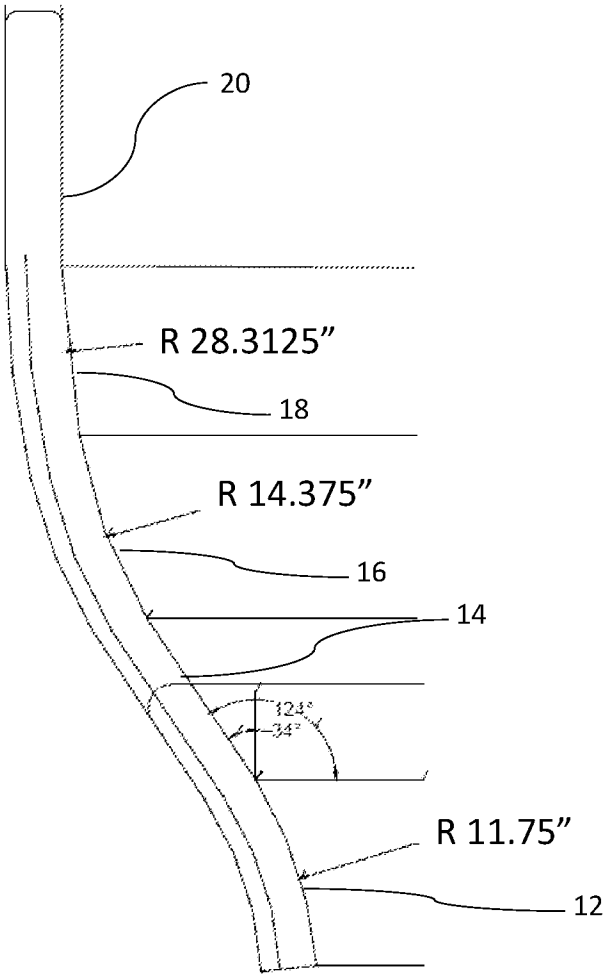
FIG. 11 is a side view dimensioned drawing of the chair back shown in FIG. 1.

The chair includes a side support 4 connected to a backrest 2 and a seat 6. The seating surface 8 as shown is generally flat but could also be curved or sculpted. The backrest 2 includes a number of different sections to create a space saving and comfortable seat which also has an aesthetically pleasing design. The lower section 12 is convex from the front view, curving away from the front of the chair. The next section 14 which is the lower middle section is straight and at a relatively high pitch. As shown in FIG. 11, the pitch is 34 degrees (pitch is measured from the vertical plane). Next, the upper middle section 16 is concave and curves towards the front of the chair and the upper most portion 18 shown is also concave but with a larger radius or more gentle curve. The lower section 12 generally has the shortest radius and is convex and has a most abrupt curve whereas the upper section and upper middle section both have larger radiuses or more gentle curves. However, the radiuses of sections 12 and 16 are relatively close, e.g. within 20-40%. It is understood that although radial sections are shown, the curves do not need to have a constant radius. FIG. 11 shows an option with an extra high backrest section 20 which can operate as a headrest. As also shown, the backrest has a constant thickness 25 and this constant thickness is across a majority of the chair (from left to right) as well as constant along the length of the backrest from top 22 to bottom 33 of the backrest and the surface area of the backrest surface.

The radius of section 12 is shown as specifically 11.75 inches. It is contemplated that this radius will be 25 inches or less, more preferably 20 inches or less, more preferably 17 inches or less or even more preferably 15 inches or less. The angle of section 14 is shown as 34 degrees. This angle preferably is at least 15 degrees, more preferably at least 20 degrees, even more preferably at least 25 degrees and most preferably more than 30 degrees with a maximum applied to any of those as being 50 degrees or less, 45 degrees or less, or 40 degrees or less (as shown, this angle is measured from vertical). Although a straight section is shown for section 14, this could instead be curved at a relatively large radius such as those described below with respect to section 18. Section 16 is shown with a radius of 14.375 inches. It is contemplated that the radius for this section 16 is at least 5 inches, more preferably at least 10 inches and even more preferably at least 12 inches but less than the radius of section 18, or less than 35 inches, or more preferably less than 30 inches. The radius of section 18 is shown as 28.3125 inches and it is contemplated that this radius is in the range of more than 20 inches, more than 25 inches and preferably less than 50 inches, more preferably less than 40 inches. It is also contemplated that section 18 could be flat. The result of the varying radii/angles described herein creates a compound curve/angle for the seat back which moves reward at a rate of inches back to inches up that is larger at the lower sections of the chair as compared to the upper sections of the char which moves back relative to up at a smaller rate (i.e. its more vertical). In this manner, the user achieves the perception and comfort of a relatively large back pitch while reducing the chair envelope to be relatively small, e.g. smaller than 17 inches, preferably 16 inches or smaller or even more preferably 15.5 inches or smaller or even 15 inches or smaller. The design of the backrest to extend backwards a high amount at the lower portions and then extend more vertically at the upper portions provides a comfortable and supportive design of the chair. For example, many people will sit in their cars with the upper part of their back separated from the seat surface itself. Thus, the seat back extends rearwards more than is necessary and it might be considered more supportive for the chair to curve towards the user in the upper sections so that the upper portion of the user's back is in contact with the backrest. With the backrest curving to be more upright, the user can be attentive in terms of watching the show or performance while at the same time having their upper back well supported.

Figure 3:
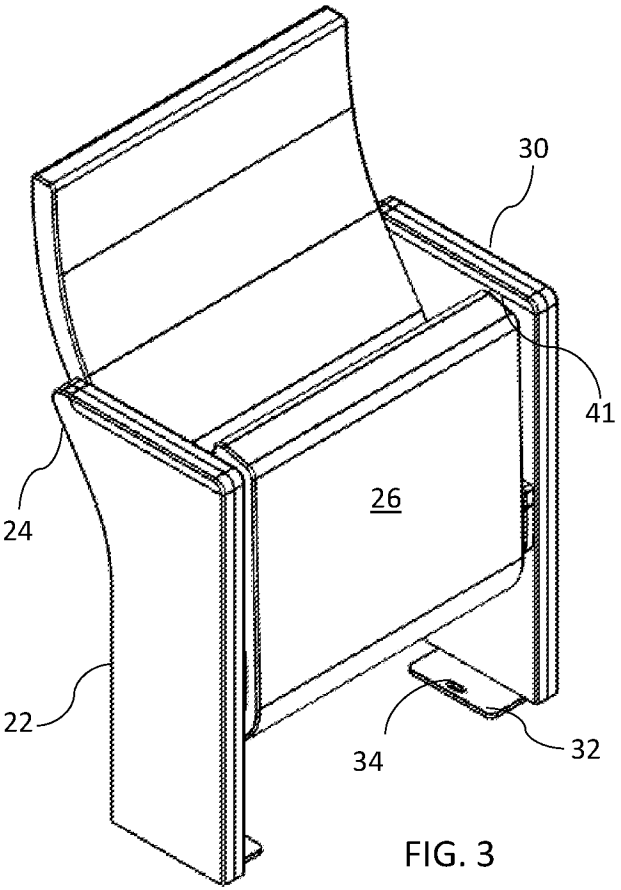
FIG. 3 is a perspective view of the chair of FIG. 1 in the unoccupied or closed position.

The supports 4 include an arm rest portion 30 which is generally flat or level. In preferred embodiments, the arm rest 30 is of a different material than the side surface 10. Preferably the arm rest includes a tougher material such as vinyl or plastics as compared to the side surface 10 which may be upholstered. As shown in FIG. 3, the lower edge 41 of the arm rest 30 is above the top most portion of the seat in the unoccupied position. However, the distance from the top most portion of the seat to the bottom of the arm rest 41 is relatively small, such as less than 2 inches, or preferably less than one inch.

The rear edge of the support includes a straight or generally vertical portion 22 and a curved/angled portion 24. The curved/angled portion 24 matches the shape of the rear of the backrest, i.e. matching the rear face opposite the angled portion 14 and the rear face opposite the curved (convex) portion 12 in that this rear portion of the backrest is concave. Like the curved part of the curved/angled portion 24. The seat 6 includes a lower surface 26 which is at an angle 29 with respect to the upper or seating surface 8. As shown in the figures, the support brackets 32 of the side supports 4 are connected to the floor/riser 1 which is the floor/riser of the stadium/theater and the side supports include flat outer 10 and inner 11 surfaces that preferably extend from below to above the seat and more preferably extend along more than 50% or even more than 60% of the total height of the chair. The support 4 includes bracket 32 with a mounting hole 34 that allows the chair to be fixed to the floor/riser.

The seat 6 tilts up and down using a gravity lift mechanism 35 such as the one in U.S. Pat. No. 9,295,334, the contents of which are incorporated by reference herein. This hinge 35 allows the seat to move from open or occupied position (FIG. 1) to the closed or unoccupied position (FIG. 3) and thus moving through an angle of rotation. Closed or unoccupied position of the seat may be due to e.g. an internal stop in the hinge or may be due to the equilibrium point of the seat, the resulting angle of rotation allows the bottom surface 26 to remain approximately parallel to the front of the supports 4. As a result the sum of the rotation angle of the seat and angle 28 is approximately equal to 180 degrees. It is understood that precisely 180 degrees is contemplated as well as approximate variations in that angle due to e.g. manufacturing tolerances, upholstery differences, variations within the hinge. This variation may be e.g. about 5 degrees as an example, however the design is that the rotation of the seat and the angle of the bottom surface 26 is designed to give the appearance of the bottom surface 26 and the front 20 aligning and/or being parallel. Further, the sum of the angle of the seat surface 8 in the occupied position (i.e. relative to level line 31) and angle 29 and angle 333 (measured relative to level) may be approximately 90 degrees.

The rear of the seat 37 is also shaped to align with or be off set from the rear 22/24 of the seat such that in the occupied position, the rear of the seat 37 aligns with the rear of the support much like what happens with surface 26 and front 20 in the un-occupied position.

Figure 8:
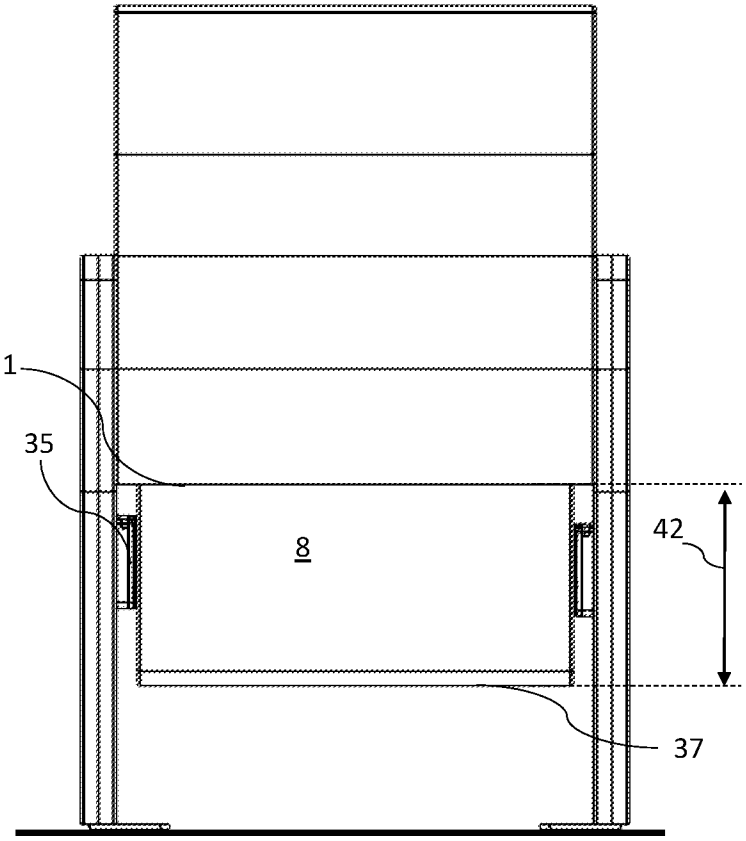
FIG. 8 a rear view of the chair of FIG. 1 in the unoccupied or closed position.
Figure 7:
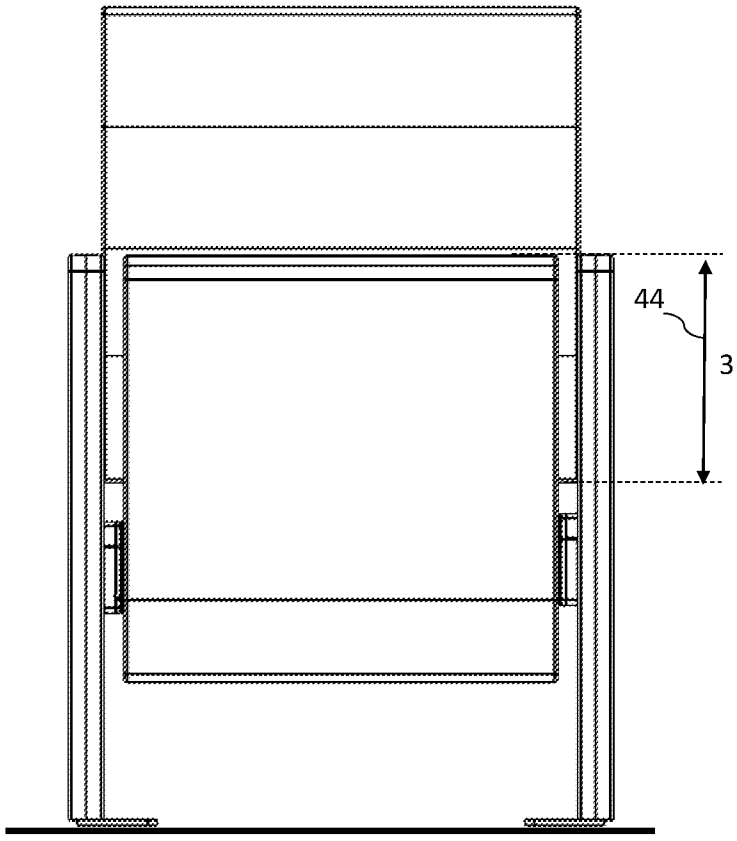
FIG. 7 a front view of the chair of FIG. 1 in the unoccupied or closed position.
Figure 10:
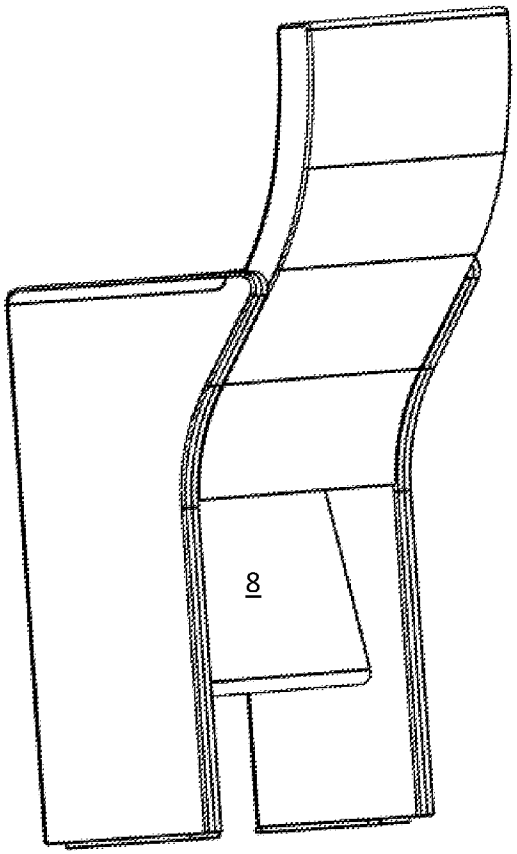
FIG. 10 is a rear perspective view of the chair of FIG. 1 in the unoccupied or closed position.
Figure 9:
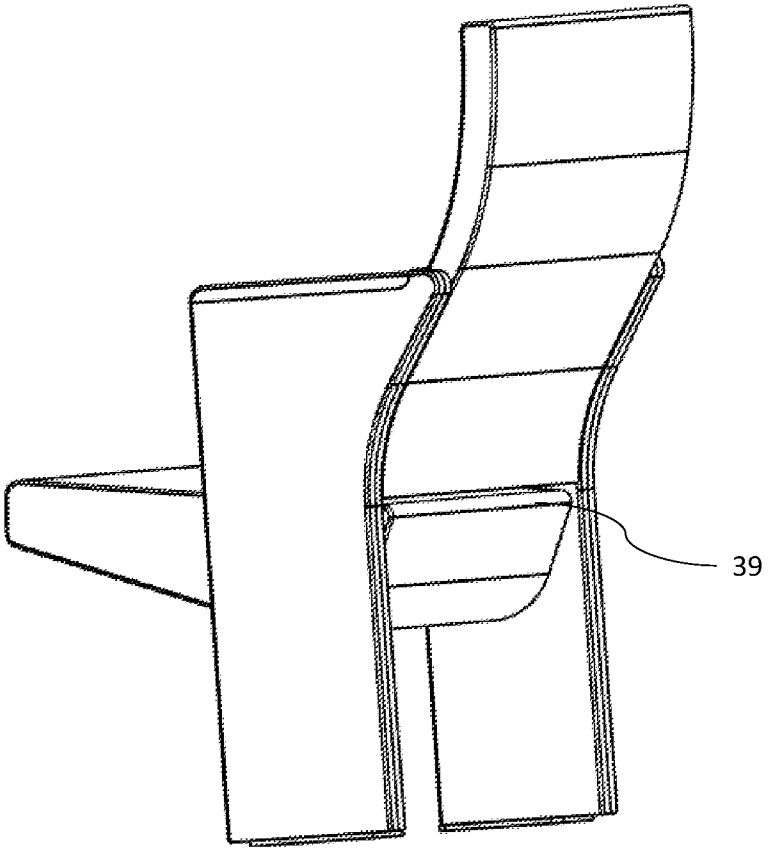
FIG. 9 is a rear perspective view of the chair of FIG. 1

The bottom of the backrest 31 and the top of the hinge mechanism 38 are spaced apart a distance 40 to provide a clear pass through space. This provides further space savings compared to prior art designs for fixed chairs. Specifically, many prior art designs have the backrest's rear surface extend substantially below the seating surface 8 in the occupied position. While this portion of the backrest may not be padded below the seating surface 8 in the occupied position, a protective plate or other blocking element will be in that area. As a result a user sitting in the row behind does not have a sight line to the seating surface 8 in the unoccupied position. In contrast, FIG. 8 shows that the seating surface 8 is visible from the rear. Furthermore, the rear of the seat 37 is also substantially below the bottom edge 33 of the backrest, particularly distance 42 represents more than 15% or even more particularly more than 20% or more than 25% of the height of the armrest (i.e. top of distance 44). As shown distance 42 is shorter than distance 44 with 44 being measured from the bottom 33 of the backrest to the uppermost point of the front 239 of the seat in the un-occupied position. Specifically, distance 44 is 1-15% larger than distance 42. Distance 42 is shown measured to the rear most portion 39 of the seat (or lower most when in the unoccupied position. Furthermore, the hinge 35 creates an axis of rotation about which the seat rotates. The distance from the axis of rotation to the rear 39 of the seat is approximately equal to or less than the distance from the axis of rotation to the rear 22/24 of the support, preferably this is measured to the vertical portion 22 of the support. As a result, the rear 39 of the seat is not visible from the side view (FIG. 2) in the occupied position, but this rear 37 is visible from the rear view and is not obscured by a protective plate or other feature of the backrest. The elimination of the protective plate/features of the backrest extending lower to obscure the rear allows for space savings and provides the users with more leg room in the front of the chair.

Figure 6:
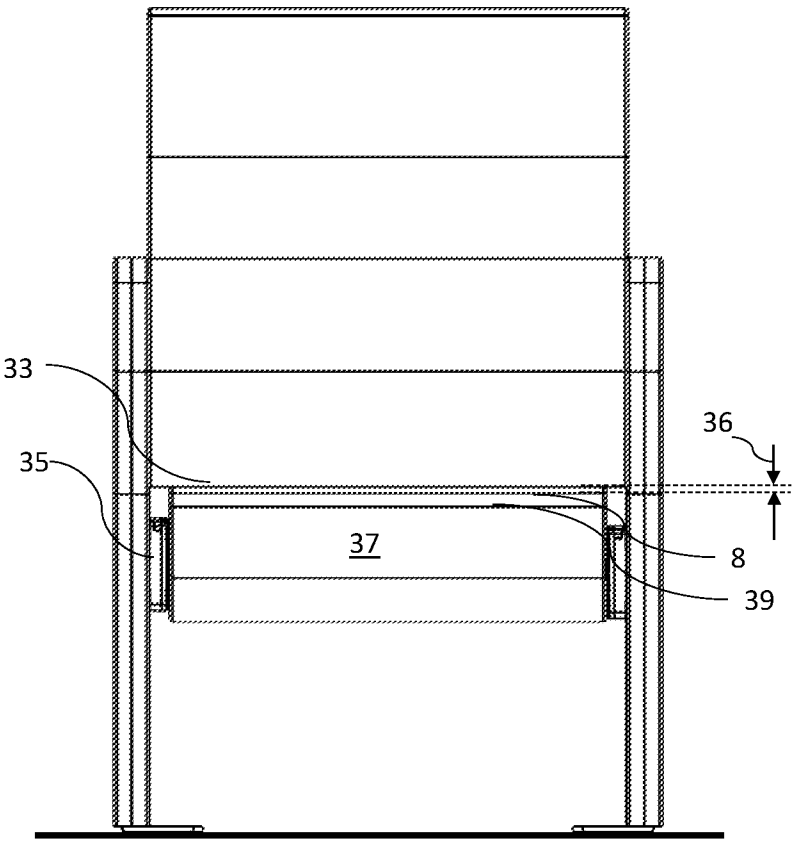
FIG. 6 is a rear view of the chair of FIG. 1
Figure 5:
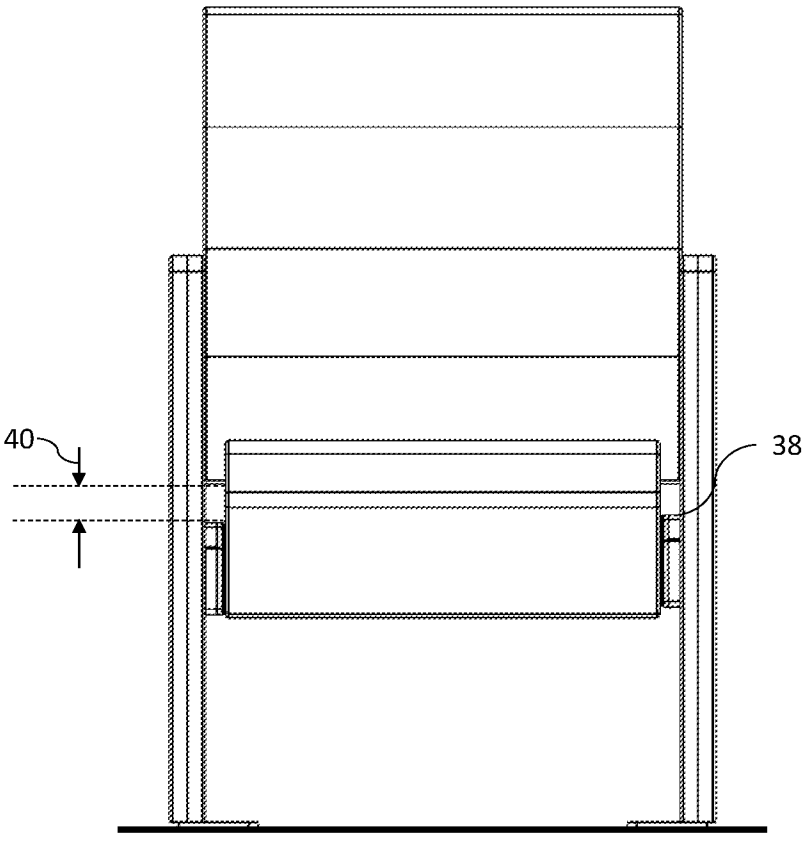
FIG. 5 a front view of the chair of FIG. 1

As further shown in FIG. 6, the top of the seat 8 in the rear is spaced below the lowest portion 33 of the backrest at a distance 36 which is relatively small, preferably less than 2 inches or even more preferably less than one inch.

Figure 12:
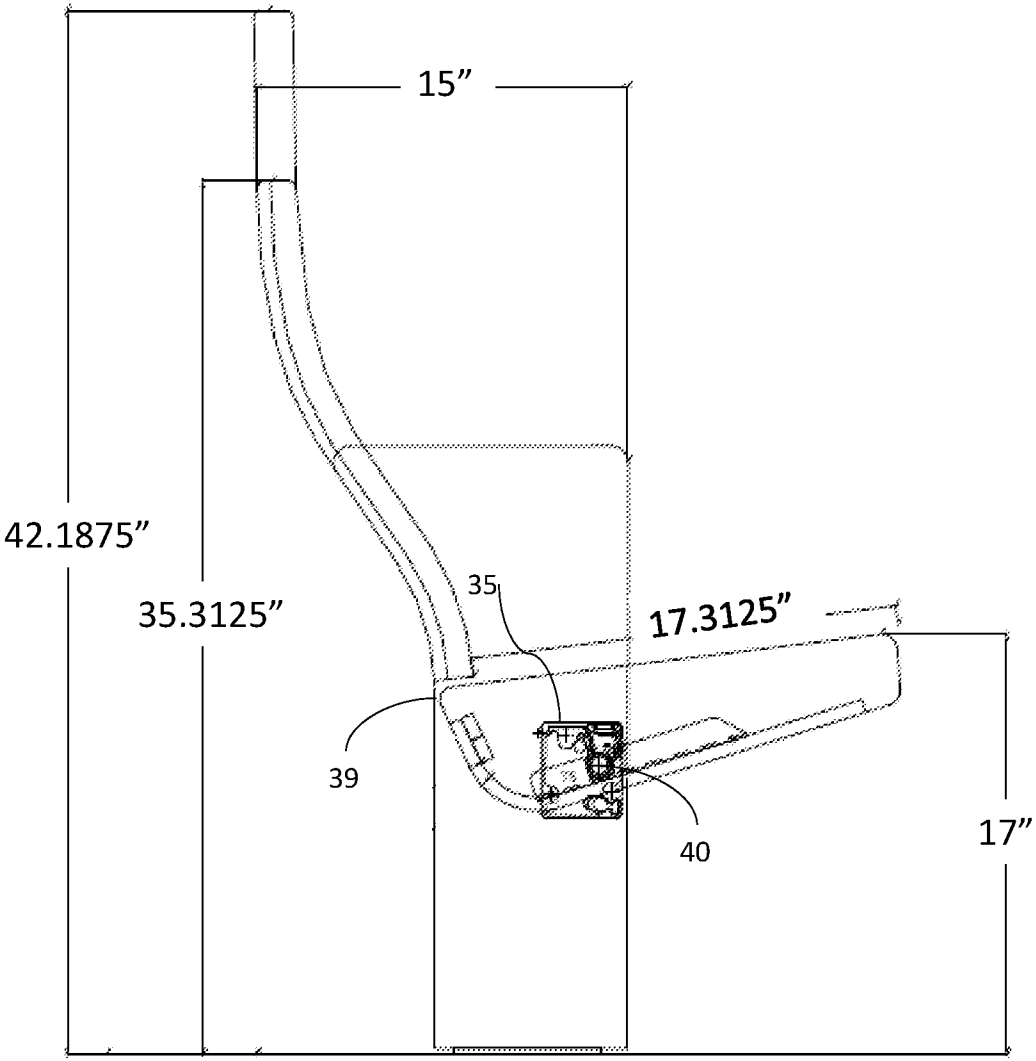
FIG. 12 is a side view dimensioned drawing of the chair back and seat of FIG. 1

The dimensioned view of FIG. 12 depicts the chair with certain elements shown in transparency and with the optional higher 42 inch back height or the alternative 35 inch back height. As can be seen, the envelope is shown to be 15 inches and this envelope would be measured when the seat is up (unoccupied position). As can be seen, the center of the bracket 35 is mounted forward of the mid point of the support. Preferably, the bracket is very close (less than 1 inch) from the front portion of the support. The axis of rotation 40 is also close to the front portion of the support, preferably less than 3 inches, more preferably less than 2 inches). Preferably the front portion of the support 20 includes a linear component which is longer than a length from the axis 40 to the front most portion of the seat in the occupied position. The measurements described herein may be approximate in that given the materials used and the compressibility and ability for the seat to tilt and manufacturing tolerances the chairs may be within that measurement by, for example a quarter inch or a half inch, or +1-10%.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A chair comprising:

a support, a back and a seat, the back and seat supported by the support and the seat pivotable with respect to the back via a gravity lift mechanism, and the support, back and seat defining a fixed chair with an envelope of approximately 17 Inches or less;

the back defining a backrest surface comprising a plurality of sections comprising first, second and third sections each having a different pitch with one or more lower ones of the plurality of sections causing a backrest surface to extend a greater distance rearward per distance upwards as compared to one or more upper ones of the plurality of sections which extend rearwards less per distance upwards the first section located at a lower end of the backrest and having a pitch angle less than approximately 20 degrees or a convex radius and extending a first distance;

the second section located above the first section and having a pitch angle greater than 25 degrees or a concave radius of at least approximately 11 inches and extending a second distance;

the third section located above the second section and having a pitch angle less than 20 degrees or radius of approximately 20 inches or greater and extending a third distance.

2. The chair of claim 1 further comprising:

a hinge configured to allow the seat to pivot between occupied and unoccupied positions wherein the support entirely obscures the seat from view from a side view of the chair when the seat is in the unoccupied position.

3. The chair of claim 1 wherein at least a first one of the one or more lower ones of the plurality of sections has a first pitch of approximately half an inch or more rearward per inch upward.

4. The chair of claim 3 wherein the first pitch is measured between two points on the first one of the lower ones of the plurality of sections and the first one of the lower ones of the plurality of sections is curved.

5. The chair of claim 4 wherein at least a one of the upper ones of the plurality of sections has a second pitch of less than approximately 0.4 inch rearward per inch upward.

6. The chair of claim 1 wherein at least one of the plurality of sections is flat and pitched back at an angle of approximately 25 degrees or more.

7. The chair of claim 1 wherein the seat is pivotable through a first angle, a lower surface of the seat includes a flat portion which is at a second angle relative to horizontal in the occupied position of the seat and a seating surface of the seat includes a flat portion that is at a third angle relative to horizontal in the occupied position and wherein a sum of the first, second and third angles is approximately 90 degrees and each of the first, second and third angles are different.

8. The chair of claim 1 wherein two or more of the first, second and third ones of the plurality of sections are curved.

9. The chair of claim 1 wherein two or more of the first, second and third ones of the plurality of sections are straight.

10. The chair of claim 1 wherein the envelope is approximately 16 inches or less and at least a portion of the backrest includes a rearward pitch of at least approximately 0.5 inches rearward or more per inch upward as measured between two points on a backrest surface of the backrest.

11. The chair of claim 10 wherein the envelope is approximately 15.5 Inches or less.

12. The chair of claim 1 further comprising a fourth section of the plurality of sections, the fourth section located above the third section and having a pitch angle less than approximately 5 degrees and extending a fourth distance.

13. The chair of claim 1 further comprising a fourth section of the plurality of sections, the fourth section located above the third section and having a pitch angle less than approximately 1.5 degrees and extending a fourth distance.

14. The chair of claim 1 wherein each of the plurality of sections has a first and second end, the first end located lower than the second end and the second end of the first section is spaced from the first end of the second section.

15. The chair of claim 1 wherein the second section has a length of at least approximately 25% of the envelope.

16. A chair comprising:

a support, a back and a seat, the back and seat supported by the support and the seat pivotable with respect to the back, and the support, back and seat defining a fixed chair with an envelope of approximately 16 inches or less;

the back defining a backrest surface comprising a plurality of sections comprising first, second and third sections and a rear surface;

the first section located at a lower end of the backrest and having a first radius and extending a first distance;

the second section located above the first section and having a pitch of at least 25 degrees and extending a second distance;

the third section located above the second section and having a second radius and extending a third distance;

a fourth section located above the third section and having a third radius;

the first radius and the second radius in inches are each within 25% to 75% of the third radius.

17. A chair comprising:

a support, a back and a seat, the back and seat supported by the support and the seat pivotable with respect to the back, and the support, back and seat defining a fixed chair with an envelope of approximately 17 inches or less;

the back defining a backrest surface comprising a plurality of sections comprising first, second and third sections and a rear surface wherein a thickness of the back measured between the backrest surface and the rear surface is constant along 50% or more of the back;

the first section located at a lower end of the backrest and having a first pitch and extending a first distance;

the second section located above the first section and having a second pitch and extending a second distance;

the third section located above the second section and having a third pitch extending a third distance;

the second pitch is at least approximately 1.5 times the first and the third pitches.

18. The chair of claim 17 wherein the second pitch is at least 28 degrees and the envelope is approximately 16 inches or less.

19. The chair of claim 17 wherein the envelope is measured horizontally between a front most portion of the support and a rear most portion of the back with the seat in an unoccupied position.

20. The chair of claim 17 wherein the thickness of the back measured between the backrest surface and the rear surface is constant along 50% or more of an entire surface area of a backrest surface of the backrest.

21. The chair of claim 17 wherein the seat has a seating surface and a lower surface and wherein in the unoccupied position the lower surface is approximately parallel to a front of the support.

22. The chair of claim 17 wherein the support includes a front profile and a rear profile and wherein a portion of the rear profile matches a profile of a rear surface of the seat back.

23. The chair of claim 17 wherein the second section has a length of at least 20% of the envelope.

24. The chair of claim 23 wherein a height of the chair from a bottom of the support to a top of the back is at least approximately 32 inches and ends of the second section are spaced vertically by 15% of the height.

25. A chair comprising:

a support, a back and a seat, the back and seat supported by the support and the seat pivotable with respect to the back, and the support, back and seat defining a fixed chair with an envelope of approximately 16 inches or less;

the back defining a backrest surface comprising a plurality of sections comprising first, second and third sections and a rear surface;

the first section located at a lower end of the backrest and having a convex radius and extending a first distance;

the second section located above the first section and having a pitch of at least 25 degrees and extending a second distance;

the third section located above the second section and having a concave radius and extending a third distance;

the convex radius and the concave radius in inches are within 35% of each other.

26. The chair of claim 25 wherein the first radius and the second radius in inches are each within 25% to 75% of the third radius.

* * * * *